US007976639B2

(12) United States Patent
Gipp et al.

(10) Patent No.: US 7,976,639 B2
(45) Date of Patent: Jul. 12, 2011

(54) METHOD FOR DETERMINING THE PERCENTAGE OF ALLERGENS PICKED UP FROM A SURFACE

(75) Inventors: Mark M. Gipp, Racine, WI (US); Timothy J. Padden, Racine, WI (US); Robert E. Rogers, Cochrane (CA); Chwen-Jyh Jeng, Edmonton (CA)

(73) Assignee: S.C. Johnson & Son, Inc., Racine, WI (US)

( * ) Notice: Subject to any disclaimer, the term of this patent is extended or adjusted under 35 U.S.C. 154(b) by 606 days.

(21) Appl. No.: 11/840,824

(22) Filed: Aug. 17, 2007

(65) Prior Publication Data

US 2009/0044643 A1 Feb. 19, 2009

(51) Int. Cl.
*B08B 1/00* (2006.01)

(52) U.S. Cl. ..... 134/6; 134/9; 134/10

(58) Field of Classification Search ..... None
See application file for complete search history.

(56) References Cited

U.S. PATENT DOCUMENTS

| | | | |
|---|---|---|---|
| 3,448,478 | A | 6/1969 | Nash et al. |
| 3,630,800 | A | 12/1971 | Nash et al. |
| 4,084,433 | A | 4/1978 | Naarding |
| 4,773,238 | A | 9/1988 | Zafiroglu |
| 4,792,363 | A | 12/1988 | Franklin et al. |
| 5,094,770 | A | 3/1992 | Sheridan et al. |
| 5,292,582 | A | 3/1994 | Gibbs et al. |
| 5,315,734 | A | 5/1994 | Kresse et al. |
| 5,981,287 | A | 11/1999 | Sinclair et al. |
| 6,130,097 | A | 10/2000 | Polzius et al. |
| 6,550,092 | B1 | 4/2003 | Brown et al. |
| 6,777,064 | B1 | 8/2004 | Brown et al. |
| 7,001,773 | B2 | 2/2006 | Lepow et al. |
| 7,195,922 | B1 | 3/2007 | Pirzad |
| 2002/0050016 | A1 | 5/2002 | Willman et al. |
| 2004/0091427 | A1 * | 5/2004 | Moodycliffe et al. ..... 424/45 |
| 2004/0208706 | A1 * | 10/2004 | Kukor et al. ..... 405/128.75 |
| 2005/0039677 | A1 * | 2/2005 | Hughes et al. ..... 118/629 |
| 2005/0130870 | A1 | 6/2005 | Ochomogo et al. |
| 2005/0287616 | A1 | 12/2005 | Gross et al. |
| 2006/0016037 | A1 | 1/2006 | Flora et al. |
| 2006/0051434 | A1 | 3/2006 | Tsuchiya |
| 2006/0137116 | A1 * | 6/2006 | Tsuchiya et al. ..... 15/1.52 |
| 2006/0160225 | A1 | 7/2006 | Gipp et al. |

FOREIGN PATENT DOCUMENTS

| | | | |
|---|---|---|---|
| EP | 077997 | A3 | 11/1996 |
| WO | WO 0110970 | | 2/2001 |
| WO | WO 02102918 | | 12/2002 |
| WO | WO 2007/031080 | A1 | 3/2007 |

OTHER PUBLICATIONS

Excerpt from EPA Final Report 747-R-95-007: Sampling House Dust for Lead, Sep. 1995.
International Search Report and Written Opinion dated Jul. 17, 2007 for PCT/US2006/049026.

* cited by examiner

*Primary Examiner* — Michael Kornakov
*Assistant Examiner* — Ryan Coleman

(57) ABSTRACT

A test method is disclosed that can be used to test cleaning products. The test method includes applying a known amount of test material to a surface, cleaning the surface and calculating the amount of allergens picked-up from the surface. The calculated amount of allergens picked-up is then corrected for several measurable variables to provide a more accurate determination of the percentage of allergens picked up with the cleaning product.

18 Claims, 6 Drawing Sheets

FIG. 4
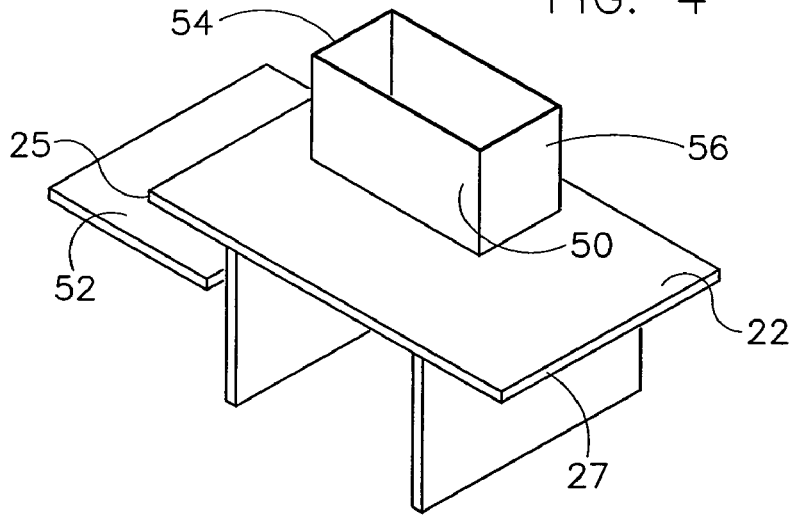
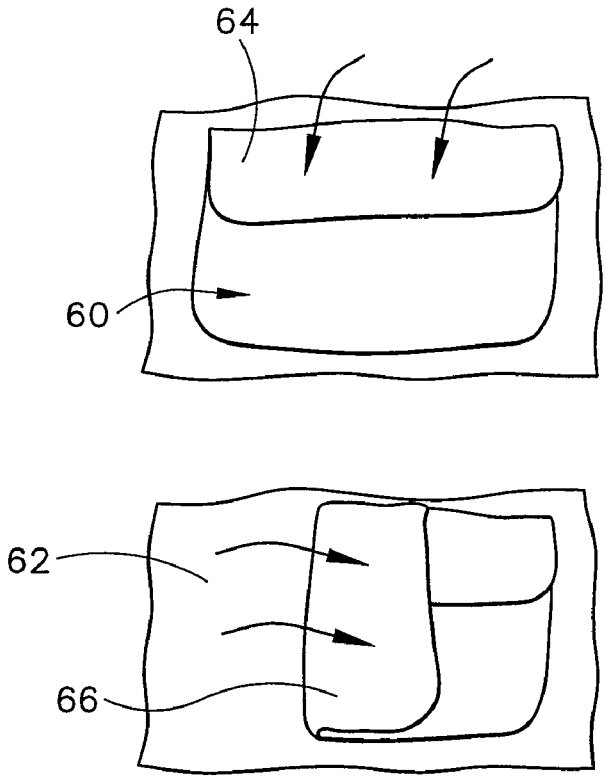
FIG. 5

METHOD FOR DETERMINING THE PERCENTAGE OF ALLERGENS PICKED UP FROM A SURFACE

BACKGROUND OF THE INVENTION

1. Field of the Invention

The present invention relates generally to a method for accurately determining the cleaning effectiveness of various household cleaning solutions and implements. Specifically, this invention relates to a method for calculating the percentage of dust containing common household allergens, e.g., cat (Fel d1) and dog (Can F1), picked up from a surface using household cleaning products, and more specifically to a method for determining the percentage of allergens picked up from a surface using a dusting cloth and a furniture polish.

2. Discussion of the Related Art

In many household environments, a number of airborne particulates, e.g., allergens, dust, and/or other airborne matter, are present which can create respiratory problems for individuals living within the home, especially those with disease conditions such as asthma. Some airborne particulates can accumulate on various readily viewable surfaces within the home, which can be aesthetically displeasing.

To manage, control, or otherwise influence the accumulation of airborne particles, numerous known devices and procedures may be utilized. For example, dust may be removed with a rag or dish cloth. However, as shown in FIG. 6, dusting with a dry cloth only scatters the dust and allergens into the air where they can be inhaled. Furthermore, dry dusting may scratch furniture due to improperly removed dust. Using a damp cloth to dust may cut down on the amount of scattering dust. Unfortunately, water from the cloth may also penetrate the furniture finish and raise the grain on wood, causing damage to wood furniture and objects. Commercial dusting formulas, e.g., Pledge® Clean & Dust spray, have been developed with a unique combination of anti-static agents that attracts and removes more dust and allergens than a plain cloth, wet or dry, alone.

With regard to the advertising of claims of allergen removal effectiveness, there is no adequate standardized objective tests to quantify the amount of allergens removed by a particular cleaning product. Therefore, a standardized, objective and repeatable test was developed.

SUMMARY OF THE INVENTION

According to the invention, a method for determining the percentage of allergens picked up from a surface with a dust cloth and a cleaning product is disclosed. The method is comprised of a series of procedures designed to account for variables and correct the test results based on these variables.

The three-pass/one-panel dusting method is a test method designed to determine the amount of dust pick-up from a finished wood panel. This dusting method includes the steps of applying a known amount of dust to a dust panel, picking up the dust with cleaning products, e.g., a cloth and furniture polish, extracting the dust and allergens into a buffer solution and assaying the solution to determine the concentration of allergens. Consequently, a number of variables must be accounted for including the concentration of allergens in a dust sample, the amount of dust and allergens lost to the air during dust application and the amount of allergens on a dusting cloth not extracted into a buffer solution. The disclosed test method determines these variables and accounts for them when calculating a corrected allergen pick up efficiency.

The inventive method is comprised of the following procedures:

- Procedure #101: collecting dust samples to determine the allergen content in the test material.
- Procedure #102: collecting a plurality of samples to determine the allergen deposition efficiency of the test material on a wood panel.
- Procedure #103: collecting a plurality of samples to determine the allergen extraction efficiency for a cleaning product, e.g., a dusting cloth containing a cleaning solution, e.g., Pledge®, applied to the cloth.
- Procedure #104: collecting a plurality of cleaning product samples used to dust a known amount of test material.
- Procedure #105: extracting allergens from the plurality of cleaning product samples.
- Procedure #106: concentrating the allergen samples from Procedure #105 for a Can f1 ELISA assay.
- Procedure #107: determining the Fel d1 concentration in the plurality of cleaning product samples with ELISA assays.
- Procedure #108: determining the Can f1 concentration in the plurality of dusting cloth samples with ELISA assays following concentration in Procedure #106.

Procedures #101 to #104 outline procedures for collecting four types of samples. The obtained samples are extracted and concentrated, if necessary, according to the procedures in Procedures #105 and #106. The process sample extracts are then assayed for Fel d1 and Can f1 allergens following Procedures #107 and #108.

These and other aspects and of the present invention will be better appreciated and understood when considered in conjunction with the following description and the accompanying figures. It should be understood, however, that the following description, while indicating preferred embodiments of the present invention, is given by way of illustration and not of limitation. Many changes and modifications may be made within the scope of the present invention without departing from the spirit thereof, and the invention includes all such modifications. In describing the preferred embodiment of the invention, specific terminology will be resorted to for the sake of clarity. However, it is not intended that the invention be limited to the specific terms so selected and it is to be understood that each specific term includes all technical equivalents, which operate in a similar manner to accomplish a similar purpose.

BRIEF DESCRIPTION OF THE DRAWINGS

The figures help illustrate the best mode currently contemplated of practicing the present invention.

In the Figures:

FIG. 4 is an isomeric view of a dust containment unit according to a preferred embodiment of the present invention;

FIG. 5 is an image of a dusting cloth folded according to a preferred embodiment of the present invention;

Figure 1:
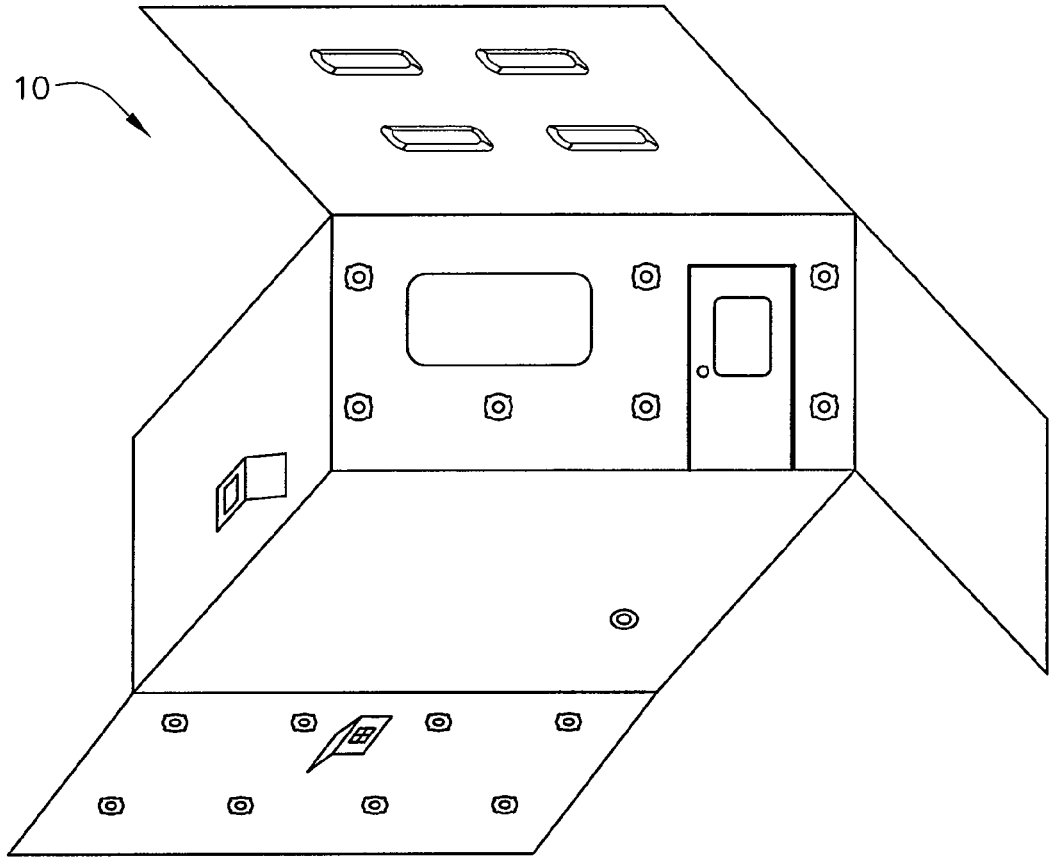
FIG. 1 is an exploded isometric view of a environmentally-controlled test chamber according to a preferred embodiment of the present invention.

In describing the preferred embodiment of the invention several aspects of which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

The present invention and the various features and advantageous details thereof are explained more fully with reference to the non-limiting embodiments described in detail in the following description.

A synthetic test dust material was used in the following inventive procedures to help ensure repeatable and reliable test results. The preferred test dust used is a combined mixture of fiber and particulate containing various substances intended to accurately reflect typical household soils. Such a dust is disclosed in U.S. Pat. No. 7,001,773 to Lepow et al., the disclosure of which is herein incorporated by reference. Other dust options are discussed in U.S. Pat. No. 6,777,064 to Brown and U.S. Pat. Pub. No. 2006/0051434 to Tsuchiya which are also incorporated by reference. The naturally occurring mean (and standard deviation) of allergen content in the combined dust used during this study was determined to be 90.4±3.0 μg/g-dust of Fel d1 allergens and 22.4±1.5 μg/g-dust of Can f1 allergens.

The cleaning product used for these tests was Pledge® Natural Beauty Lemon furniture polish and was applied directly to cotton dusting cloths according to the disclosed procedure. However, any type of cleaning products can be used for this test method including, but not limited to Pledge® Multi-Surface Clean & Dust™ Spray, other brands of furniture polish or dusting sprays, and disposable cleaning products such as Pledge® Grab-It® and Swiffer® dusters and the like.

The particular dusting cloths used were 100% cotton terry cloths obtained from Wal-Mart (RN #52469 white, twelve inches by twelve inches). The cloths were machine washed once with detergent (100 mL Sunlight Ultra Fragrance Free) and machine washed only with water two additional times to eliminate any residual detergent. The triple-washed cloths were then machine dried once, with any loose threads trimmed and stored in bags before used in the test. Prior to use in the procedures, the terry cloths were placed on a conditioning rack and conditioned for at least two hours at a constant temperature and relative humidity or until the cloth weight is stable.

Figure 2:
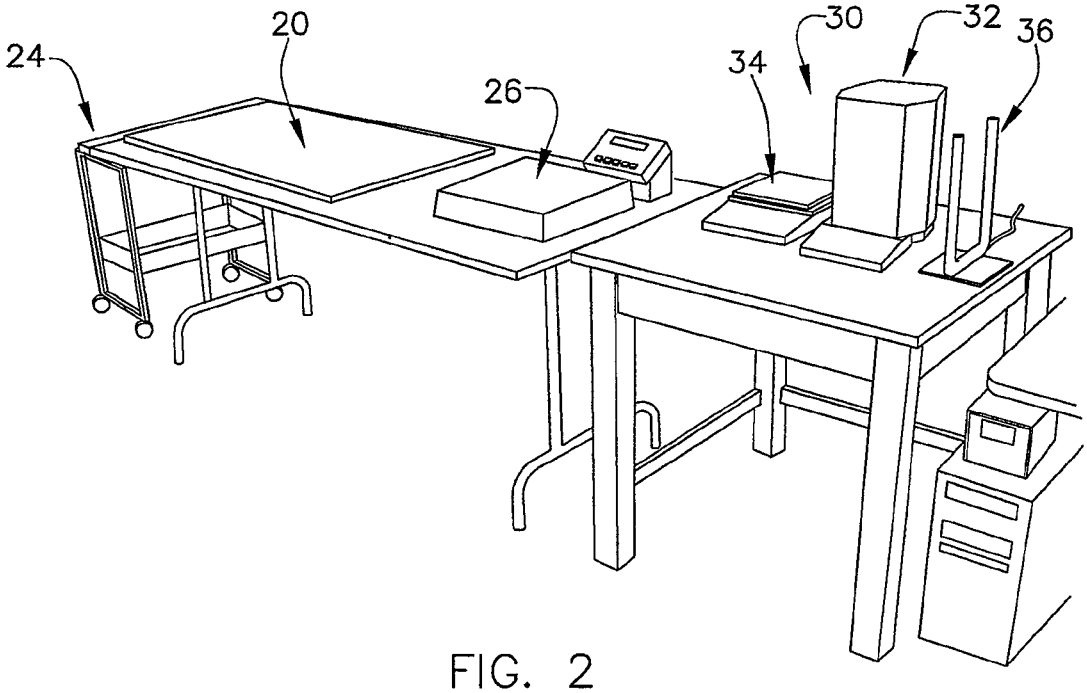
FIG. 2 is an isometric view of a portion of the test chamber of FIG. 1 containing a dust application station according a preferred embodiment of the present invention.
Figure 3:
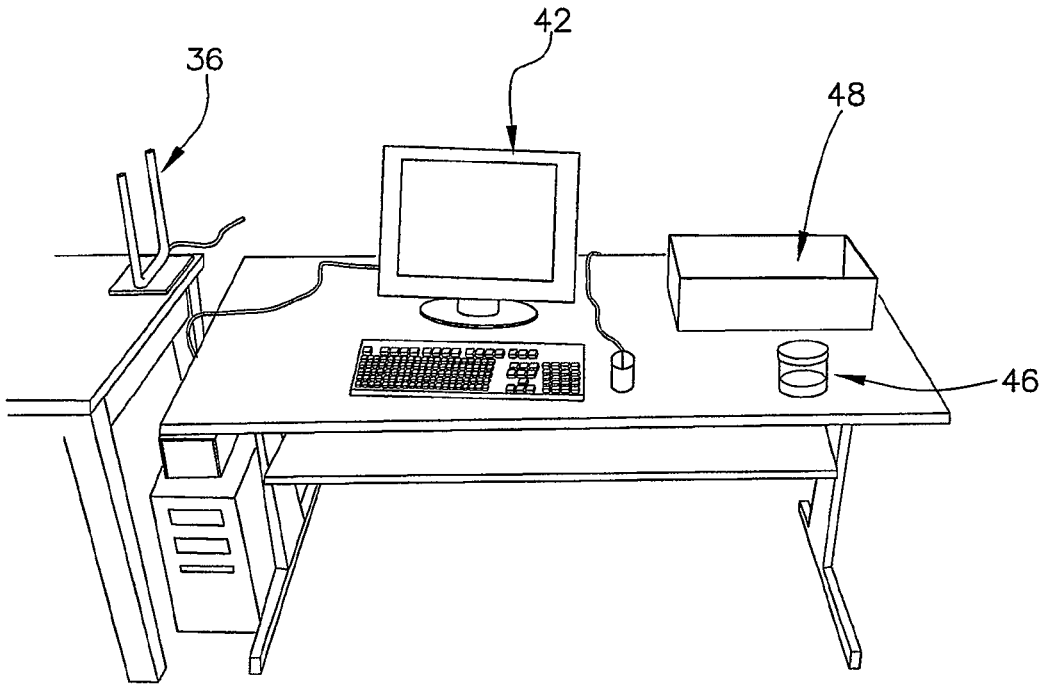
FIG. 3 is an isometric view of a work station located adjacent to the dust application station of FIG. 2.
Figure 6:
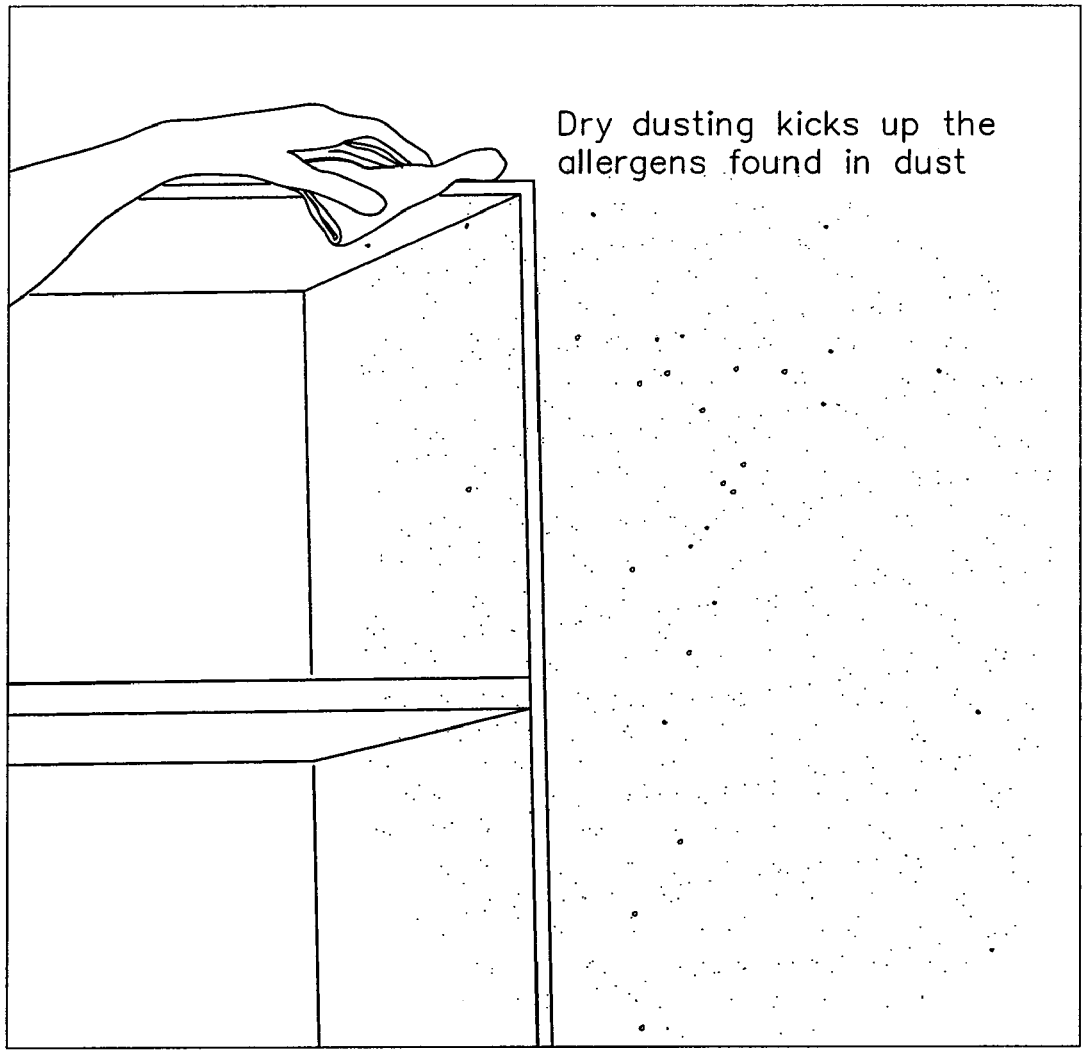
FIG. 6 is an image of a prior art dusting method.

For consistent standardized results, Procedures #101-#104 are preferably run in a controlled environment. These inventive test procedures were run in an environmentally-controlled simulated residential exposure room or test chamber, identified by reference number 10 in FIG. 1, measuring sixteen feet square and eight feet high such as that shown in. The environmental conditions within the room 10 were maintained within 72±5° F. and 50±5% relative humidity. A cool mist/vapor portable humidifier, e.g., Vicks Ultrasonic Humidifier, Bionaire BCM1745 Cool Moisture Humidifier or equivalent, was used to create and maintain the test conditions. FIGS. 2 and 3 shows the preferred equipment arrangement of the test chamber 10 including dusting station 20 and balance station 30. The dusting station 20 includes test panel 22, dust push-off collection cart 24, and dusting force calibration unit 26. The balance station 30 includes analytical balance 32, table top balance 34, and antistatic frame 36. A work station 40 in the test chamber 10 comprises a computer 42 running a database software application 44. A dust jar 46 and dust jar roller box 48, i.e., a box that permits the dust jar 46 to be safely rolled back and forth, are also preferably kept at the work station 40.

For the test procedures involving the handling of potentially airborne dust, a half facepiece respirator (e.g., 3M 6000 series with 60921 cartridges for particulate and organic vapor) was worn by the testers. Disposable gloves (e.g., TNT blue nitrile gloves 92-675) were worn during the test steps involving handling of dust or buffer solution.

At the beginning of each test day, a NIST-certified thermohygrometer (i.e., dual temperature/humidity gauge) and the humidifier were turned on. A preferred thermohygrometer is Model 4185 made by the Control Company of Friendswood, Tex. The environmental conditions within the test chamber were adjusted until they were within the desired range. The jar 46 containing test dust was rotated upside down ten times to break up any dust stratification and thoroughly mix the dust.

The computer 42, balances 26, 33, 34, and anti-static unit 36 were also turned on. After the computer and balances were operational, the spreadsheet software application used for data recording, e.g., Microsoft Excel, was opened. The analytical balance communication software application, e.g., Mettler Toledo BalanceLink, was also opened. In order to verify that the analytical balance 32 was communicating properly with the computer/database software application, the balance 32 was made to send a stabilized weight reading to the spreadsheet application. Finally, the balances were calibrated with NIST-certified standard calibration weights (including 20 mg, 100 mg, 1 g, 10 g, 100 g, 200 g, 300 g, 1 kg, 5 kg).

Once a dusting methodology was finalized, a definitive study was conducted using the inventive method for product claim support. The study was completed over a two week period. A total of ten control dust samples (obtained via Procedure #101), ten deposition efficiency (DE) tests using the wash method (Procedure #102), and ten dusting tests (Procedure #104) were conducted. Fifteen samples were collected during each study week. Five samples were each collected on Monday, Tuesday and Wednesday. The samples were extracted (Procedure #105) and centrifuged (Procedure #106) on the same day. The samples to be tested for Can f1 were further concentrated with a Centricon device (Procedure #106). The samples were stored in a refrigerator at 4° C. until the ELISA assay (Procedures #107 and #108). Each sample was replicate assayed on Thursday and Friday. The data obtained was then applied to support a cleaning product claim regarding allergen pick-up effectiveness from a surface. At the end of each test day, the test chamber was cleaned and the test materials are returned to storage. At the end of the test study week, the test chamber was deep cleaned.

The test method described in further detail below, sets forth the best mode of determining the percent allergen pick-up of a cleaning product.

Procedure #101—Allergen Concentration in Synthetic Household Dust

The concentration of allergens in a test material, i.e., synthetic household dust in this example, can be determined by extracting a known mass of the dust applied to a dusting cloth with a known volume of extraction buffer. The buffer is then extracted and assayed to determine the allergen concentration in the dust. The following procedure outlines the steps to obtain and prepare control dust samples to evaluate the allergen concentration in the synthetic household dust.

A. Equipment

1. Four-digit analytical balance (Mettler AX304, AG245 or equivalent), connected to a computer running Mettler Balance Link software V3.01.
2. Anti-static device for analytical balance (HAUG GmbH & Co. KG Model PRX U or equivalent).
3. Dust jar roller box (17"×5¼").

B. Materials

1. Heavy duty aluminum foil cut to 3"×3" (Sunspun 45 cm×100 m or equivalent)
2. Synthetic household dust, e.g., dust as described in the aforementioned U.S. Pat. No. 7,001,773
3. Kimwipes® EX-L paper or equivalent
4. Spatula
5. 150 mL modified extraction buffer per sample (explained below)
6. 250 mL clear glass jars (VWR W220-0250 or equivalent)
7. 250 mL graduate cylinder (Fisher Sci. 2234 250±1 mL or equivalent).

C. Steps

A sample jar is prepared by adding 150 mL of extraction buffer to the jar and place a label on it. The label includes a database file name and a unique sample ID to uniquely identify each sample. Before applying any dust, the dust supply jar is rolled at least fifteen times within a roller box to mix up the particulate and fibers.

The weight of a 3"×3" aluminum foil piece is tared. Using a clean spatula, approximately forty-five milligrams of test dust is measured out onto the foil. Forty-five milligrams of dust mimics the amount that deposits on a dusting panel when applying seventy-five milligrams of dust with a sieve application method such as that disclosed in Procedure #104. After the balance reading has stabilized, the dust weight is recorded.

The dust and foil is carefully placed into the sample jar. The dust is not permitted to fall freely into the buffer but rather the dust is slowly immersed into the buffer solution to minimize any dust suspension loss. The preferred extraction buffer solution is not a standard ELISA wash buffer (as used for the Fel d1 and Can f1 assays in Procedures #107 and 108). Instead, the ELISA wash buffer is reformulated with a higher concentration, i.e., 3.5%, of Tween® 20 non-ionic surfactant. The reformulated buffer solution is necessary because the silicone content of the cleaning product prevents water-based and other organic solvent buffer solutions from effectively extracting allergens. However, standard ELISA wash buffer may still be used for plain dust samples with no cleaning products containing silicone on them.

These steps are repeated as necessary to collect the desired number of samples.

D. Report

The test dust ID and the mass of dust used in each run is reported. After the sample extraction procedure (Procedure #105) and ELISA assays (Procedures #107 & 108), the allergen concentration in the control dust samples is reported.

$$C_{allergen\text{-}in\text{-}dust} = \frac{C_{allergen-buffer} \times V_{buffer}}{M_{dust-CT}}$$

where, $C_{allergen\text{-}in\text{-}dust}$ is allergen concentration in surrogate household dust (μg/g-dust), $C_{allergen\text{-}buffer}$ is concentration of allergen in extraction buffer (μg/mL), $V_{buffer}$ is volume of extraction buffer used to extract household dust (mL), $M_{dust\text{-}CT}$ is mass of dust used in this sample (g).

E. Results

Table 1 presents allergen concentrations in the synthetic test dust ($C_{allergen\text{-}in\text{-}dust}$) for the ten control dust samples. The mean allergen concentrations in the synthetic dust were 90.4±3.0 μg/g-dust for Fel d1 allergens and 22.4±1.5 μg/g-dust for Can f1 allergens. The standard deviation was low, indicating that allergens were distributed uniformly with the bulk dust.

TABLE 1

Allergen Concentration in the synthetic dust

| Sample ID | Dust Weight (g) | Total Fel d1 (μg) | Total Can f11 (μg) | Allergen Concentration Fel d1. (μg/g-dust) | Allergen Concentration Can f1. (μg/g-dust) |
|---|---|---|---|---|---|
| CT1 | 0.0444 | 4.2 | 1.0 | 94.8 | 22.4 |
| CT2 | 0.0454 | 4.0 | 1.1 | 88.4 | 24.4 |
| CT3 | 0.0449 | 3.9 | 0.9 | 87.5 | 20.5 |
| CT4 | 0.0463 | 4.1 | 1.0 | 88.9 | 22.4 |
| CT5 | 0.0449 | 4.2 | 1.0 | 93.4 | 23.2 |
| CT6 | 0.045 | 4.1 | 1.1 | 90.3 | 23.9 |
| CT7 | 0.0443 | 4.1 | 0.9 | 92.9 | 20.1 |
| CT8 | 0.0448 | 3.8 | 1.0 | 84.9 | 21.2 |
| CT9 | 0.0449 | 4.1 | 1.1 | 91.5 | 23.8 |
| CT10 | 0.0451 | 4.1 | 1.0 | 91.5 | 22.2 |
| Mean | 0.0450 | 4.1 | 1.0 | 90.4 | 22.4 |
| Std Deviation | 0.0006 | 0.13 | 0.07 | 3.0 | 1.5 |
| CV (%) | 1.2 | 3.1 | 7.3 | 3.3 | 6.5 |

CT#: control dust sample number

Procedure #102—Allergen Deposition Percentage: Wash Method

When dust is applied onto a test panel, not all of the dust and allergens are deposited onto the panel. Instead, a measurable amount of dust and allergens are lost to the air or to the sides of the containment box. The percentage of allergen deposited on the testing panel compared to the total amount applied must be determined in order to calculate the corrected allergen pick-up efficiency. This "allergen deposition efficiency" factor (DE) is defined as the percentage of allergens on the panel as compared to the total allergens in the approximately seventy-five milligrams of dust applied.

It was initially assumed that the deposition efficiency of allergens was the same as the applied dust. Therefore, the percentage mass of dust deposited on the panel was compared with total dust mass to estimate the deposition efficiency. However, this procedure was not as successful due to the difficulties associated with accurately measuring the small mass increase on the panel and significant run-to-run and operator-to-operator variation. A direct allergen measurement technique that used a variety of cloth wipes, wet and dry, to collect deposited dust and allergens from the panel was then attempted. The wipes were extracted and ELISA assayed to assess allergen deposition efficiency. This technique also had problems due to the failure of cloth wipes to effective pick-up all of the deposited allergens.

Finally, a wash method was designed and proven to produce a reproducible allergen deposition efficiency determination. The procedure includes applying a known amount of dust to a dust containment unit or box 50 (see FIG. 4). The applied dust deposits on to an array of overlapping stainless steel plates covering the dusting area. However, the entire amount of applied dust does not deposit onto the plates and must be accounted for.

After the test dust was applied, each plate was sequentially washed in three buffer containers with a known volume of buffer to ensure maximum recovery. The wash buffer was extracted and ELISA assayed to determine the actual mass of deposited allergens. From this value, the allergen deposition efficiency can be calculated.

A. Equipment

1. W. S. Tyler No. 100 mesh sieve (150 micron)
2. Four-digit analytical balance
3. Anti-static device for analytical balance
4. Tabletop balance (Satorius BP 3100P max 3100 g, or equivalent)
5. Dust containment box: bottomless, topless box to outline and contain test dust when applied to deposition plates (area 15-¼"×34-½", i.e. 3.63 $ft^2$)
6. Dust jar roller box B. Materials 1. Panel cleaning towels (100% cotton, for panel cleaning with mineral spirits)
2. Lint-free KleanWipes® paper (for panel cleaning with DI water)
3. 57 mm aluminum weighing dishes (VWR 25433-008 or equivalent)
4. Spatula
5. Standard synthetic household dust
6. Mineral spirits in a wash bottle (Stoddard Solvent Fisher Sci. S457-4)
7. Deionized (DI) water in a wash bottle
8. Twelve 6"×9" stainless steel deposition plates
9. Heavy duty aluminum foil
10. Kimwipes® EX-L papers
11. Three washing pans (6"×11" baking pans)
12. Three 3" plastic scrapers
13. 200 mL standard ELISA extract buffer per sample
14. 250 mL clear glass sample jar
15. 100 mL graduate cylinder (Fisher Sci. 9556 100±0.5 mL or equivalent)

C. Steps

The weight of one empty extraction jar is measured and recorded. A sample label is placed on the jar. The label includes a database file name and a unique sample ID. The label information is sufficiently unique to identify each sample.

The deposition plate is prepared by first placing a piece of clean aluminum foil on the designated dust application area. Next, the twelve deposition plates are laid down in two rows, six plates each, on the foil. The plates are overlapped by at least two millimeters to prevent any dust loss in gaps. The overall area of the deposition plates is slightly larger than the dust application area.

The dust containment box 50 is cleaned with a piece of wet KleanWipes® paper and let air dry. Before using the test dust, the dust jar 46 is rolled at least fifteen times within the roller box 48, along the 17" side, to mix the particulate and fibers. An aluminum weighing boat is tared and, using a clean spatula, approximately seventy-five milligrams of dust is measured out into the weighing boat. After the balance reading has stabilized, the dust weight is recorded.

The dust containment box 50 is then placed on top of the deposition plates. The 100 mesh sieve is checked to ensure there is no contamination dirt on it. If necessary, the sieve is tapped to clean any contamination. The sieve is not solvent- or water-cleaned under normal use to ensure a constant layer of dust on the sieve, necessary for reproducible dust application. The dust is sieved five to seven inches above the plates within the containment box 50. Caution is taken to prevent dust piles, i.e., "hot spots." Fingers are kept on the edge of the sieve during dust application and the dust layer on the plates is not disturbed. After applying the dust, the dust is allowed to settle for sixty seconds. The containment box 50 is slowly removed away from the dust application area to avoid any further suspension loss.

Next, three wash pans and a plastic scraper are placed in sequential order beside the deposition area and 50 mL of ELISA wash buffer is added to each pan. Each wash pan is tilted about 30° to one side so that the washing buffer accumulates in one side to facilitate plate washing. The top most deposition plate is carefully collected and slowly transferred to the first wash pan in a horizontal orientation to minimize dust loss. Once the plate is on top of the first wash pan, one side of the plate is slowly tilted into the wash buffer. The scraper is used to slowly brings wash buffer over the plate and wet the dust layer. The wet dust is then scraped into the wash buffer. The plate is washed two or three times until most of the dust is washed down into the first wash pan. Before moving to the second wash pan, any remaining dust attached to the back of the deposition plate is scraped down, including any dust in the immersed area. The washing/rinsing procedure is repeated for the deposition plate in the second and third wash pans. The washing steps are then repeated in a sequential order, from top to bottom, for the remaining eleven plates.

After washing the dust from all twelve deposition plates, the first wash pan is rinsed and the wash buffer poured into a sample jar. The second wash pan is rinsed and the wash buffer contained therein is used to rinse the first wash pan. This second wash buffer portion is then poured into the sample jar. The third wash pan is then rinsed with the wash buffer used to rinse the second and first wash pans sequentially. After consecutive rinses, the third wash buffer portion is poured into the sample jar. 50 mL of clean buffer solution is used to rinse the third, second, and first wash pans sequentially and then poured into the sample jar. The final weight of the sample jar is measured and the actual amount of wash buffer used is calculated. The sample jar is stored in a safe place before extraction.

After completing the procedure, the stainless steel plates, wash pans, and scrapers are rinsed with tap water to remove any residual wash buffer. The plates are rinsed again with DI water to remove any residual tap water minerals. The cleaned materials are wiped dry or allowed to air dry before being used again. This method may be repeated to collect additional samples as needed.

D. Report

The mass of dust used in each run and type of containment box 50 used is recorded as is the mass of wash buffer in each sample. After the sample extraction (Procedure 105) and ELISA assay (Procedures 107 & 108), the allergen deposition efficiency is determined and recorded.

$$DE = \frac{C_{allergen-WS} \times V_{WS}}{M_{dust-WS} \times C_{allergen-in-dust}} \times 100$$

where,

DE is allergen deposition efficiency (%), $C_{allergen-WS}$ is allergen concentration in wash sample extract (μg/mL), $V_{WS}$ is volume of wash buffer (mL), $M_{dust-WS}$ is mass of dust used in this wash sample (g), and $C_{allergen-in-dust}$ is allergen concentration in synthetic dust (μg/g-dust).

D. Results

Table 2 presents the allergen deposition efficiency (DE) for the ten wash samples. The mean deposition efficiency for Fel d1 was 84.2±7.1% and 71.7±10.1% for Can f1.

TABLE 2

Allergen deposition efficiency using the wash method

| Sample ID | Applied Dust Weight (g) | Total Fel d1 (μg) | Total Can f11 (μg) | Allergen Deposition % (DE) Fel d1. (%) | Allergen Deposition % (DE) Can f1 (%) |
|---|---|---|---|---|---|
| WS1 | 0.0756 | 4.9 | 1.0 | 71.8 | 61.8 |
| WS2 | 0.0755 | 5.6 | 1.1 | 81.8 | 62.9 |
| WS3 | 0.0753 | 5.0 | 1.1 | 73.5 | 64.3 |
| WS4 | 0.0752 | 6.2 | 1.3 | 90.9 | 79.8 |
| WS5 | 0.0759 | 6.1 | 1.5 | 88.6 | 87.0 |
| WS6 | 0.0752 | 5.5 | 1.0 | 81.3 | 62.0 |
| WS7 | 0.0745 | 5.9 | 1.1 | 87.6 | 66.0 |
| WS8 | 0.0753 | 5.8 | 1.2 | 84.7 | 69.1 |
| WS9 | 0.0748 | 6.1 | 1.3 | 90.1 | 77.4 |
| WS10 | 0.0744 | 5.2 | 1.4 | 91.7 | 86.9 |
| Mean | 0.0752 | 5.7 | 1.2 | 84.2 | 71.7 |
| Std Deviation | 0.0005 | 0.5 | 0.2 | 7.1 | 10.1 |
| CV (%) | 0.6 | 8.3 | 14.2 | 8.4 | 14.1 |

WS#: wash sample number

Procedure #103—Extraction Efficiency Method

The allergens assayed on a dusting cloth sample are typically not fully extracted into the buffer solution due to the interaction between the cleaning product, e.g., Pledge® and the dusting cloth. This so-called "extraction efficiency" (EX) must be determined with simulated dusting samples in order to correct for the allergen pick-up efficiency. The simulated samples were processed with the same extraction procedure and ELISA methods to mimic the extraction efficiency for an actual dusting sample with cleaning product.

The simulated dusting samples were prepared by applying approximately forty-five milligrams of dust on a piece of 7"×4" dusting cloth with a cleaning product, e.g., Pledge® previously applied. Forty-five milligrams of dust mimics the percentage (approximately 60%) of dust that typically deposits on the dusting area in Procedure #104. The dust was well mixed with the cleaning product to simulate the dust-cleaning product mixture on a typical dusting cloth.

A. Equipment

1. Four-digit analytical balance and computer
2. Anti-static device for analytical balance
3. Tabletop balance
4. Dust jar roller box B. Materials 1. Heavy duty aluminum foil cut into to 3"×3", 6"×9" sheets, and 40" long pieces
2. 4"×7" terry cloth—Cut from 12"×12" Cloth (100% Cotton, White Color)
3. Spatula.
4. Synthetic household dust
5. Pledge®—Natural Beauty Lemon furniture polish
6. Kimwipes® EX-L papers
7. Tweezers
8. 150 mL modified extraction buffer per sample (see Procedure #101)
9. 250 mL clear glass sample jar
10. 250 mL graduate cylinder
11. Roller scissors
12. Cutting board and ruler C. Steps A piece of 25" aluminum foil is placed on a table away from the testing materials to avoid contamination. The target mass of cleaning product applied to each terry cloth is 1.5±0.1 g.

Next, a sample jar is prepared by adding 150 mL of modified extraction buffer to the jar. A label having a unique sample ID is placed on the jar. Before using any dust, the dust jar 46 is rolled fifteen times within the roller box 48, along the 17" side, to homogenize the particulate and fibers. Next, one 3"×3" aluminum foil piece is placed on the balance and tared. Using a clean spatula, approximately forty-five milligrams of dust is measured out onto the foil. As previously discussed, forty-five milligrams of dust is approximately the average amount of dust that deposits onto a dusting panel when applying seventy-five milligrams of dust with the sieve application method discussed in Procedure #104. After the balance reading has stabilized, the weight of the dust is recorded.

Next, a 6"×9" aluminum foil piece is placed on the tabletop balance and the balance is tared. One 4"×7" terry cloth is placed onto the foil and the initial weight of the cloth is recorded. Another clean 6"×9" aluminum foil piece is then placed in the central area of the cleaning product application station and the terry cloth is moved to this foil. The 7" side of the cloth is aligned horizontally to the cleaning product applicator.

The can of cleaning product spray is vigorously shaken for at least thirty seconds to ensure a homogeneous mixture. The nozzle of the cleaning product container is kept approximately eight inches above the cloth. The cleaning product is applied to the terry cloth with a three-pass method. During the three-pass application, the cleaning product trigger nozzle is continuously pressed to deliver a consistent spray volume. If the application speed is controlled at approximately one second per pass, approximately 1.5 g of cleaning product will be deposited on the cloth, though practice may be required to achieve consistent results. The three-pass application preferably is started outside the cloth at the left-hand-side. After the cleaning product can is emitting a stable spray, the cleaning product container is moved left-to-right across the cloth until the spray stream passes the cloth. The application direction is reversed to complete the second pass right-to-left and reversed yet again to complete the third pass left-to-right.

The final weight of the cloth is measured and recorded immediately after the three-pass application of cleaning product. From this weight, the mass of the applied cleaning product is calculated. The target range for cleaning product mass on the cloth is 1.5±0.1 g. If the mass of the cleaning product is less than 1.4 g, a fine-tune spray application of cleaning product is necessary. If the mass of the cleaning product is over 1.6 g, the cloth is discarded and the three-pass application redone with a new cloth. To ensure a consistent application rate, a can of cleaning product should be decommissioned when its mass has decreased by half, e.g., about 230 g for a standard container of Pledge®.

After the application of the cleaning product, the dust is carefully placed on the cloth while taking caution to prevent suspension dust loss. The dust is spread across the cloth and pressed into the cloth with a force similar to that of panel dusting. All of the dust particles ideally are in contact with the cleaning product in order to accurately mimic actual dusting operations. Next, the cloth is folded and the reverse side is used to wipe any residual dust on the 3"×3" foil. After checking the sample ID, the cloth sample is carefully placed into the sample jar. Using tweezers, the cloth is opened and "washed," i.e., agitated, several times inside the jar to extract most of the dust particles. The lid is then closed and the sample jar is stored in a safe place before extracting dust following the steps of Procedure #105—Sample Extraction. This extraction procedure is repeated as necessary to collect additional samples.

D. Report

The test dust lot ID and the mass of dust used in each run is recorded. The cleaning product ID and mass of cleaning product on each sample is also recorded. After the sample extraction (Procedure #105) and ELISA assays (Procedures #107 and #108), the allergen extraction efficiency (EX), calculated with the following formula, is recorded.

$$EX = \frac{C_{allerge-EX} \times V_{EX}}{M_{dust-EX} \times C_{allergen-in-dust}} \times 100$$

where,

EX is extraction efficiency (%), $C_{allergen-EX}$ is the allergen concentration in EX sample extract (μg/mL), $V_{EX}$ is volume of extraction buffer (mL), $M_{dust-EX}$ is the mass of dust used in the EX sample (g), and $C_{allergen-in-dust}$ is allergen concentration in synthetic household dust (μg/g-dust).

E. Results

Tables 3 and 4 present the extraction efficiency (EX) data for Fel d1 and Can f1, respectively. The extraction efficiency for Fel d1 allergens was 90.5±4.4% and 86.5±10.9% for Can f1 allergens.

TABLE 3

Fel d1 allergen extraction efficiency (EX) for simulated dusting samples

| Sample ID | Applied Dust Weight (g) | Applied Pledge Mass (g) | Recovered Fel d1 (μg) | Fel d1 Extraction Eff. (EX) (%) |
|---|---|---|---|---|
| EX1 | 0.0446 | 1.44 | 3.3 | 82.8 |
| EX2 | 0.0444 | 1.61 | 3.5 | 87.1 |
| EX3 | 0.0445 | 1.45 | 3.8 | 95.1 |
| EX4 | 0.0445 | 1.49 | 3.8 | 95.2 |
| EX5 | 0.0459 | 1.75 | 3.8 | 91.3 |
| EX6 | 0.0442 | 1.60 | 3.7 | 91.2 |
| EX7 | 0.045 | 1.42 | 3.7 | 90.7 |
| Mean | 0.0447 | 1.5 | 3.7 | 90.5 |
| Std Deviation | 0.0006 | 0.1 | 0.2 | 4.4 |
| CV (%) | 1.3 | 7.9 | 5.2 | 4.8 |

EX#: extraction efficiency sample number

TABLE 4

Can f1 allergen extraction efficiency (EX) for simulated dusting samples

| Sample ID | Applied Dust Weight (g) | Applied Pledge Mass (g) | Recovered Can f1 (μg) | Can f1 Extraction Eff. (EX) (%) |
|---|---|---|---|---|
| EX1 | 0.0462 | 1.53 | 0.87 | 83.2 |
| EX2 | 0.0448 | 1.43 | 0.78 | 77.2 |
| EX3 | 0.0458 | 1.46 | 0.96 | 92.3 |
| EX4 | 0.0446 | 1.60 | 1.0 | 96.5 |
| EX5 | 0.0448 | 1.49 | 1.0 | 102.1 |
| EX6 | 0.0453 | 1.42 | 0.8 | 82.2 |
| EX7 | 0.0444 | 1.58 | 0.7 | 71.8 |
| Mean | 0.0451 | 1.5 | 0.9 | 86.5 |
| Std Deviation | 0.0007 | 0.1 | 0.1 | 10.9 |
| CV (%) | 1.5 | 4.7 | 13.5 | 12.6 |

EX#: extraction efficiency sample number

Procedure #104—Dusting Process Three-Pass/One-Panel Method & Allergen Pick-Up Efficiency (Before and After Correction for DE and EX)

The allergen pick-up efficiency (PU) is defined as the percentages of allergens picked up by a piece of cloth treated with a cleaning product. A number of factors, or variables, must be determined through the steps in Procedures #101-#103 to provide a corrected, i.e., more accurate, allergen pick-up efficiency.

A. Equipment

1. Panel—surfaces used to dust (i.e. wood, glass, etc.). Note: If possible, the push off edge of the panel should be undercut at about 40° so soil does not hang up on the edge of the panel
2. 100 mesh sieve
3. Four-Digit analytical balance
4. Anti-Static device for analytical balance
5. Tabletop balance
6. Tabletop balance (OHAUS I-10, max 10 kg, or equivalent).
7. Dust containment box
8. Dust jar roller box B. Materials 1. Panel cleaning towels
2. Lint-free KleanWipes® paper
3. 57 mm Aluminum weighing dishes (VWR 25433-008 or equivalent)
4. Spatula
5. Synthetic household dust
6. Pledge—Natural Beauty Lemon furniture polish
7. 100% Cotton terry cloths
8. Mineral spirits in a wash bottle
9. Deionized (DI) water in a wash bottle
10. Plastic cups—16 oz capacity
11. Heavy duty aluminum foil
12. Kimwipes® EX-L paper
13. 150 mL modified extraction buffer per sample (see Procedure #101)
14. 250 mL clear glass sample jar
15. 250 mL graduate cylinder
16. Tweezers
17. Roller scissors
18. Cutting board and ruler C. Steps A piece of 25" aluminum foil is placed on an application table. The application table is located away from the testing materials to avoid contamination. The target mass of a cleaning product on a terry cloth is 1.5±0.1 g. A sample jar is prepared by adding 150 mL of modified extraction buffer to a sample jar and a sample label is placed on the jar. The label includes a database program file name and a unique sample ID. The label information is sufficiently unique so as to easily identify each sample.

The dusting panel 22 is aligned within the designated area on a support table 23. The left side 25 of the panel 22 extends by about one inch outside the table 23 so that any push-off dust (i.e., dust "pushed" off the panel 22 but not retained on the cloth) will fall on a piece of push-off collection foil located on the push off collection cart 24. Mineral spirits are applied to the panel 22 in an "s" shaped pattern and then the panel 22 is wiped with a clean shop towel to remove the mineral spirits. The cloth is reversed and the panel 22 is cleaned a second time. The same cloth is used to clean the panel edges. Special caution is taken to clean the push-off edge, i.e., left side 25, as dust may become trapped there. The mineral spirit cleaning procedure is repeated one time.

When the panel 22 is dry, the panel 22 is cleaned with a deionized water-saturated KleanWipes® paper to eliminate any static electricity that built-up during the mineral spirits cleaning. A dry KleanWipes® paper is used to dry the panel 22. The timer is started and the panel 22 is air dried for at least 8 minutes. If the panel 22 is not used within thirty minutes, the panel cleaning procedures are redone to ensure consistent surface conditions. During the panel 22 drying period, the dust containment box 50 is cleaned with a wet KleanWipes® paper and air dried. While the panel 22 is drying, it is beneficial to practice consistently applying a 1.4 kg dusting force with a piece of practice cloth on the Ohaus tabletop balance 34.

During the eight minute panel drying period, a terry cloth 60 is placed onto a 9"×6" aluminum foil piece 62 as shown in FIG. 4. The terry cloth 60 is folded into a 4"×7" size through the steps shown. A first portion 64 of the cloth 60 is folded over approximately 5" to form a 12"×7" footprint. Next, a first four inch side section 66 is folded inward from the left side. Finally, a second four inch side section 68 is folded inward from the right side. The initial weight of the terry cloth 60 and aluminum foil piece 62 is measured and recorded with the balance. The weight is stable if the cloth 60 is fully conditioned.

The push-off collection foil 52 is prepared by cutting a piece of 30" aluminum foil. This is done at the beginning of a study day so that foil can also be conditioned with the chamber atmosphere. The foil is folded and placed in a 16 oz. plastic cup. The initial weight of the foil and cup is measured with the Mettler analytical balance. After the balance reading has stabilized, the weight is recorded in the spreadsheet.

The synthetic household dust is prepared by first rolling the dust jar 46 fifteen times within the roller box 48 as explained above. The weight of an aluminum weighing dish is tared on the Mettler analytical balance 32. Using a clean spatula, approximately 75 mg of dust is measured out onto the weighing dish. When the balance reading has stabilized, the dust weight is recorded.

After the test panel 22 has dried, the dust containment box 50 is placed onto the panel 22 with the left side 54 of the box 50 aligned with the push-off edge 25. As shown in FIG. 4, the front side 27 of the panel 22 is about two inches from the right side edge 56 of the containment box 50.

The 100 mesh sieve must not have any visible dirt on it. If necessary, the sieve is tapped to remove any contaminants. The sieve is not solvent or water cleaned under normal use to ensure a constant layer of dust on the sieve for reproducible dust applications. Next, the dust is sieved from a height of five to seven inches above the panel 22.

After completing the three-pass dusting procedure, the cloth is held dust side up to prevent any falling dust loss and moved carefully to a cutting board. The cloth is laid flat with the dusting side up and the cloth is unfolded carefully. The 4"×7" dusting area is cut with the roller cutter, folded, and carefully put into a sample jar after checking the sample ID. The tweezers is used to agitate the cloth several times to facilitate dust extraction. The sample jar is stored in a safe place before performing the steps of Procedure #105—Sample Extraction. The dust application and dusting procedures are repeated as necessary to obtain the desired number of samples.

D. Report

The test dust lot ID, mass of dust used, type of containment box 50 used, cleaning product ID and mass of cleaning product used in each dusting procedure is recorded. After completing the sample extraction steps (Procedure #105) and ELISA assays (Procedure #107 and #108), the allergen pick up percentage before correction is calculated and recorded using the following formula.

$$PU = \frac{C_{allergen-PU} \times V_{PU}}{M_{dust-PU} \times C_{allergen-in-dust}} \times 100$$

where,

PU is the allergen pick up efficiency (%), $C_{allergen-PU}$ is the allergen concentration in pick up sample extract (μ/mL), $V_{PU}$ is the volume of extraction buffer (mL), $M_{dust-PU}$ is the mass of dust used in this pick up experiment (g), and $C_{allergen-in-dust}$ is the allergen concentration in synthetic household dust (μg/g-dust).

However, the allergen pick up efficiency must also be corrected for both the allergen deposition efficiency (DE—calculated in Procedure #102) and cleaning product-cloth sample extraction efficiency (EX—calculated in Procedure #103) using the following formula.

$$PU_{corrected} = \frac{PU}{\left(\frac{EX}{100}\right) \times \left(\frac{DE}{100}\right)}$$

where, $PU_{corrected}$ is corrected allergen pick-up efficiency (%),

PU is allergen pick up efficiency (%, before correction),

EX is allergen extraction efficiency from pick-up sample (%), and

DE is allergen deposition efficiency (%).

E. Results

Table 5 presents corrected allergen pick-up ($PU_{corrected}$) for ten dusting samples obtained with terry cloths and an aerosol Pledge® cleaning product. The mean allergen pick-up efficiency for Fel d1 allergens was 93.0±9.0% and 94.6±13.7% for Can f1 allergens.

TABLE 5

Corrected allergen pick-up efficiency ($PU_{corrected}$) using the three-pass/one-panel dusting method

| Sample ID | Applied Dust Weight (g) | Pick-up Fel d1 (μg) | Pick-up Can f1 (μg) | Corrected Allergen Pick-Up Fel d1. (%) | Corrected Allergen Pick-Up Can f1 (%) |
|---|---|---|---|---|---|
| PU1 | 0.0741 | 4.4 | 0.9 | 78.0 | 75.2 |
| PU2 | 0.0743 | 5.1 | 1.0 | 90.6 | 83.5 |
| PU3 | 0.0767 | 4.9 | 1.2 | 83.7 | 94.6 |
| PU4 | 0.0759 | 5.8 | 1.1 | 99.5 | 91.2 |
| PU5 | 0.075 | 5.9 | 1.4 | 104.1 | 113.7 |
| PU6 | 0.0747 | 5.2 | 1.0 | 90.8 | 85.3 |
| PU7 | 0.0754 | 5.2 | 1.1 | 90.5 | 89.5 |
| PU8 | 0.0743 | 5.0 | 1.1 | 88.5 | 89.3 |
| PU9 | 0.0752 | 5.6 | 1.3 | 97.1 | 105.8 |
| PU10 | 0.0756 | 6.1 | 1.4 | 106.9 | 118.0 |
| Mean | 0.0751 | 5.3 | 1.2 | 93.0 | 94.6 |
| Std Deviation | 0.0008 | 0.5 | 0.2 | 9.0 | 13.7 |
| CV (%) | 1.1 | 9.8 | 14.9 | 9.6 | 14.5 |

PU#: pick-up Sample number

Procedure #105—Sample Extraction

The samples collected from Procedures #101 to #104 are extracted with the following sample extraction procedure.

A. Equipment

1. Horizontal shaker (IKA HS 501 or equivalent)
2. Eppendorf® 5804 centrifuge or equivalent
3. 15 mL Eppendorf® centrifuge tube adapters
4. Four-digit analytical balance
5. Anti-static device
6. 1-5 mL Finnpipette® pipette
7. Timer B. Materials 1. Sample in 250 mL clear glass Jars
2. 5 mL Finnpipette® pipette tips
3. Tweezers
4. Kimwipes EX-L Paper
5. 15 mL centrifuge tubes (Corning 430766 or equivalent)
6. 2 mL sample vials (labeled with a sample ID)
7. Centricon Plus-20 concentration devices (10,000 NWML, labeled with a sample ID and initial weight recorded with Mettler analytical balance).
8. Sample labels C. Steps The sample jars are placed in an extraction box with spacers placed between the jars to prevent collisions. The extraction box is securely affixed onto a horizontal shaker with appropriate elastic straps. The shaker is turned on, adjusted to a shaking frequency of 250 RPM, and run for two hours.

Four tubes of extracted buffer are centrifuged for each sample. Two of tubes are for the Can f1 Centricon sample concentration procedure (Procedure #106), one tube is for the Fel d1 assay (Procedure #107), and one is saved as a backup.

The centrifuge tubes are labeled with the appropriate sample ID numbers. The Finnpipettes® are set at 4.5 mL volume. Three pipettes of extraction buffer are transferred into each of the four centrifuge tubes. The sample jar is shaken by hand immediately before pipetting to ensure representative sampling. If the sample contains a terry cloth, a tweezers is used to mix the sample buffer before pipetting. Next, the centrifuge tubes are placed in tube adapters and the assembly is placed into the centrifuge. The weight of opposite swing buckets are balanced using dummy tubes if necessary. The samples are centrifuged at 4000 RPM for twenty minutes and then carefully placed the centrifuged tubes on a tube rack. Special caution is taken as the silicon and water layers may be mixed by even a slight agitation.

The Finnpipette® is set at 4.0 mL volume. The pipette tip is carefully inserted into the centrifuged tube and a water sample is collected for a Centricon device. This step is repeated for another centrifuged tube to collect a total of 8 mL in the Centricon device. The final weight of the Centricon is measured and the mass of the extraction buffer is calculated. Centricon samples are processed following Procedure #106.

The pipette tip is carefully inserted into the third centrifuged tube to collect a 2 mL water sample into a 2 mL sample vial. The 2 mL sample vials are stored in a refrigerator at 4±2° C. before the Fel d1 ELISA assay (Procedure #107). The sample jars and the fourth centrifuged tubes as backup are stored in a freezer at −20±5° C.

D. Report

The timing of each step is recorded in the spreadsheet as is the mass of extraction buffer in each Centricon device.

Procedure #106—Sample Concentration/Centricon Process Method

Preliminary ELISA assays indicated that 150 mL of extraction buffer was an appropriate volume for Fel d1 allergen extraction. The concentration of Fel d1 is such that it can be directly ELISA assayed (Procedure 107) after the centrifuge step (Procedure 105). However, the concentration of Can f1 was near or below the detection limit (1 ng/ml) of a standard ELISA assay. It was concluded that the extraction buffer must be concentrated prior to the ELISA assay for Can f1 (Procedure 108). Experimental results indicated that a Centricon Plus-20 concentration device would concentrate Can f1 to 20-30 ng/ml, which is in the linear range of the calibration curve. Experiments were conducted to develop the following definitive concentration procedure.

A. Equipment

1. Centrifuge
2. Centrifuge tube adapters
3. Four-digit analytical balance
4. Anti-static device for analytical balance
5. 50-200 μL Finnpipette®

B. Materials

1. Centricon Plus-20 concentration devices containing centrifuged sample buffer obtained in Procedure #105
2. 200 μL TipOne® pipette tips (No. 1111-1806 or equivalent)
3. 20 mL scintillation glass vials (Kimble Glass Inc. or equivalent)
4. 2 mL sample vials (VWR 66010-562, labeled with sample ID)
5. 0.5 mL plastic centrifuge vial
6. Kimwipes® EX-L paper
7. Sample labels C. Steps The Centricon devices are placed into centrifuge adapters and the Centricon samples obtained in Procedure #105 are centrifuged at 4000 g (4325 RPM for the Eppendorf 5804 Centrifuge) for twenty minutes. After the samples have been centrifuged, the Centricon devices are carefully placed on a tube rack.

The initial weight of a 200 μL pipette tip and labeled 20 mL vial is measured with an analytical balance. This pipette tip is used to collect unfiltered retentate in to the vial. The pipette tip is placed in the vial and the vial cap is closed to avoid any evaporation loss.

The Centricon is attached with a labeled retentate collection cup and the assembly is reverse spun at 1000 g (1250 RPM for the Eppendorf 5804 Centrifuge) for one minute. The recovered retentate is transferred with the same pipette tip to the mL vial. The final weight of the 20 mL vial with the pipette tip is measured and the total recovery of retentate is calculated by subtracting the initial weight of the empty vial and tip. The reverse-spin recovered retentate is viscous due to the higher concentration of Tween® 20. The pipette tip is used to mix any recovered retentate and the retentate is pipetted into a labeled 2 mL vial for Can f1 ELISA assay (Can f1 ELISA Procedure 108).

The Finnpipette is set at 100 μL volume and the weight of a 0.5 mL labeled centrifuge vial is tared with the analytical balance. Next, 100 μL of retentate is pipetted into the vial, the vial cap closed and the vial final weight recorded. the retentate density and recovered sample volume is calculated and the retentate is returned to the 2 mL vial. The 100 μL retentate is not discarded due to the minimal volume of recovered retentate. The 2 mL vial is stored in a refrigerator at 4±2° C. until the Can f1 ELISA assay of Procedure #108.

D. Report

The recovered retentate mass is recorded and the retentate density and volume of recovered retentate is calculated.

$$D = \frac{M}{V}$$

where,

D is retentate density (g/mL),

M is mass of 100 μL retentate (g),

V is 100 μL.

Procedure #107—Fel d1 ELISA Assay Method

Samples are ELISA assayed according to the following steps to determine the amount of Fel d1 allergens contained therein.

1. Coat Nunc™ 96-well Microplates with Antibody Anti-Fel d1.

A 1/1000 dilution of a Fel d1 antibody, preferably MA-6F9 (available from Indoor Biotechnologies, Inc. of Charlottesville, Va.), is prepared using 50 mM carbonate-bicarbonate buffer. The total required volume (V) of coating buffer needed for a batch of assay is calculated by determining the number of microplates (n) and using the following equation:

$$V=10\times n+1=_____\text{mL}.$$

Each well is coated with 100 μL of diluted MA-6F9 solution. A visual inspection is performed to ensure that each well has the same volume of solution. Next, the microplates are wrapped with plastic wrap, e.g., Saran Wrap, and incubated overnight at 4° C. or for at least 8 hours. The incubation start time is then recorded. The microplates are washed five times with 250 μL of PBST buffer and the washing time is recorded.

2. Block Microplates with a 1% BSA PBS-T Buffer Solution.

The total required volume of 1% BSA PBST solution is prepared in a pipette basin. Each well is blocked with 100 μL of 1% BSA PBST solution and visually checked to see if each has a similar volume of solution. The microplate is then incubated at room temperature for 30 minutes. After incubation, the microplates are again washed five times with 250 μL of PBST buffer and the washing time is recorded.

3. Prepare Allergen Standard and Assay Samples

The microplate layout is determined as shown in Table 6.

TABLE 6 microplate layout for ELISA Assay

| | 1 | 2 | 3 | 4 | 5 | 6 | 7 | 8 | 9 | 10 | 11 | 12 |
|---|---|---|---|---|---|---|---|---|---|---|---|---|
| Row A | | | | | Standard 1 | | | | | | | Blank |
| Row B | | | | | Standard 2 | | | | | | | |
| Row C | | Standard 3-1 | | | | Sample ID | | | | Sample ID | | |
| Row D | | Sample ID | | | | Sample ID | | | | Sample ID | | |
| Row E | | Sample ID | | | | Standard 3-2 | | | | Sample ID | | |
| Row F | | Sample ID | | | | Sample ID | | | | Sample ID | | |
| Row G | | Sample ID | | | | Sample ID | | | | Sample ID | | |
| Row H | | Sample ID | | | | Sample ID | | | Std 3-3 | | | Blank |

The standard concentration and sample dilution is determined as shown in Table 7.

TABLE 7 standard concentration (ng/mL)/sample dilution (1:2) for Fel d1 Assay

| | 1 | 2 | 3 | 4 | 5 | 6 | 7 | 8 | 9 | 10 | 11 | 12 |
|---|---|---|---|---|---|---|---|---|---|---|---|---|
| Row A | 80 | 40 | 20 | 10 | 5 | 2.5 | 1.25 | 0.63 | 0.31 | 0.16 | BK | BK |
| Row B | 80 | 40 | 20 | 10 | 5 | 2.5 | 1.25 | 0.63 | 0.31 | 0.16 | BK | BK |
| Row C | 80 | 40 | 20 | 10 | 1:2 | 1:4 | 1:8 | 1:16 | 1:2 | 1:4 | 1:8 | 1:16 |
| Row D | 1:2 | 1:4 | 1:8 | 1:16 | 1:2 | 1:4 | 1:8 | 1:16 | 1:2 | 1:4 | 1:8 | 1:16 |
| Row E | 1:2 | 1:4 | 1:8 | 1:16 | 5 | 2.5 | 1.25 | 0.63 | 1:2 | 1:4 | 1:8 | 1:16 |
| Row F | 1:2 | 1:4 | 1:8 | 1:16 | 1:2 | 1:4 | 1:8 | 1:16 | 1:2 | 1:4 | 1:8 | 1:16 |
| Row G | 1:2 | 1:4 | 1:8 | 1:16 | 1:2 | 1:4 | 1:8 | 1:16 | 1:2 | 1:4 | 1:8 | 1:16 |
| Row H | 1:2 | 1:4 | 1:8 | 1:16 | 1:2 | 1:4 | 1:8 | 1:16 | 0.31 | 0.16 | BK | BK |

The volume of BSA PBST buffer in each well is determined as shown in Table 8.

TABLE 8

BSA PBST buffer volume (μL) for Fel d1 Assay

| | 1 | 2 | 3 | 4 | 5 | 6 | 7 | 8 | 9 | 10 | 11 | 12 |
|---|---|---|---|---|---|---|---|---|---|---|---|---|
| Row A | 180 | 100 | 100 | 100 | 100 | 100 | 100 | 100 | 100 | 100 | 100 | 100 |
| Row B | 180 | 100 | 100 | 100 | 100 | 100 | 100 | 100 | 100 | 100 | 100 | 100 |
| Row C | 180 | 100 | 100 | 100 | 100 | 100 | 100 | 100 | 100 | 100 | 100 | 100 |
| Row D | 100 | 100 | 100 | 100 | 100 | 100 | 100 | 100 | 100 | 100 | 100 | 100 |
| Row E | 100 | 100 | 100 | 100 | 100 | 100 | 100 | 100 | 100 | 100 | 100 | 100 |
| Row F | 100 | 100 | 100 | 100 | 100 | 100 | 100 | 100 | 100 | 100 | 100 | 100 |
| Row G | 100 | 100 | 100 | 100 | 100 | 100 | 100 | 100 | 100 | 100 | 100 | 100 |
| Row H | 100 | 100 | 100 | 100 | 100 | 100 | 100 | 100 | 100 | 100 | 100 | 100 |

The sample and standard volume is determined as shown in Table 9.

TABLE 9

| sample and standard volume (μL) for Fel d1 Assay | | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Row A | 20 | 0 | 0 | 0 | 0 | 0 | 0 | 0 | 0 | 0 | 0 | 0 |
| Row B | 20 | 0 | 0 | 0 | 0 | 0 | 0 | 0 | 0 | 0 | 0 | 0 |
| Row C | 20 | 0 | 0 | 0 | 100 | 0 | 0 | 0 | 100 | 0 | 0 | 0 |
| Row D | 100 | 0 | 0 | 0 | 100 | 0 | 0 | 0 | 100 | 0 | 0 | 0 |
| Row E | 100 | 0 | 0 | 0 | 0 | 0 | 0 | 0 | 100 | 0 | 0 | 0 |
| Row F | 100 | 0 | 0 | 0 | 100 | 0 | 0 | 0 | 100 | 0 | 0 | 0 |
| Row G | 100 | 0 | 0 | 0 | 100 | 0 | 0 | 0 | 100 | 0 | 0 | 0 |
| Row H | 100 | 0 | 0 | 0 | 100 | 0 | 0 | 0 | 0 | 0 | 0 | 0 |

The total required volume (V) of 1% BSA PBST solution is prepared in a pipette basin. The determined volume of BSA-PBST is added into each wells as is the determined volume of sample. Serial 2× dilutions are performed four times from D1/H1 sequentially to D4/H4 as shown in Table 7. Serial 2× dilutions are also performed four times from C5/D5 & F5/H5 sequentially to C8/D8 & F8/H8 and from C9/G9 sequentially to C12/G12.

20 uL of Fel d1 standard (also from Indoor Biotechnologies Inc.) is added in wells A1, B1, and C1. Serial 2× dilutions are performed from A1/B1 sequentially to A10/B10. Serial 2× dilutions are performed from C1 sequentially to C4, and then from E5 sequentially to E8, and then from H9 to H10.

The microplates are then incubated at room temperature for two hours with the start time recorded. The microplates are washed five times with the 250 μL PBST buffer and the washing time is recorded.

4. Add Biotinylated anti-Fel d1 Monoclonal Antibodies.

The total required volume of 1/1000 dilution of an anti-Fel d1 monoclonal antibody, preferably BI-3E4 (also from Indoor Biotechnologies Inc), with 1% BSA-PBST buffer is prepared in a pipette basin. 100 uL of diluted BI-3E4 solution is pipetted into each well and incubated at room temperature for one hour. The start time is recorded. The microplates are then washed five times with a 250 uL PBS-T buffer and the washing time is recorded.

5. Add Streptavidin-Peroxidase Conjugate

The total required volume of 1/1000 dilution reconstituted Streptavidin-Peroxidase with BSA-PBST is prepared. 100 uL of diluted Streptavidin-Peroxidase is pipetted into each well. The microplates are incubated at room temperature for 30 minutes. The start time is recorded. The microplates are then washed five times with a 250 uL PBS-T buffer and the washing time is recorded.

6. Color Development

The total required volume of 1/1000 dilution of 30% $H_2O_2$ with 1 mM ABTS-70 mM citrate phosphate buffer is prepared. 100 uL of diluted $H_2O_2$ solution is pipetted into each well. At least one minute passes prior to developing the next plates to allow sufficient time to read a plate before the next plate finishes color development. Each microplate is read at 405 nm repeatedly until the optical density of wells A1 and B1 reaches 2.0-2.4. The reading time is recorded and the ELISA procedure is recorded with ELISA reports.

Procedure #108—Can f1 ELISA Assay Method

Concentrated samples are ELISA assayed according to the following steps to determine the amount of Can f1 allergens contained therein.

1. Coat Nunc™ 96-well Microplates with Antibody Anti-Can f1.

A 1/1000 dilution of a Can f1 antibody, preferably MA-6E9 (Indoor Biotechnologies Inc.), is prepared using 50 mM carbonate-bicarbonate buffer. The total required volume (V) of coating buffer needed for a batch of assay is calculated by determining the number of microplates (n) and using the following equation:

$$V=10\times n+1=_____\text{mL}.$$

Each well is coated with 100 μL of diluted MA-6E9 solution. A visual inspection is performed to ensure that each well has the same volume of solution. Next, the microplates are wrapped with plastic wrap, e.g., Saran Wrap, and incubated overnight at 4° C. or for at least 8 hours. The incubation start time is then recorded. The microplates are washed five times with 250 μL of PBST buffer and the washing time is recorded.

2. Block Microplates with a 1% BSA PBS-T Buffer Solution.

The total required volume (V) of 1% BSA PBST solution is prepared in a pipette basin. Each well is blocked with 100 μL of 1% BSA PBST solution and visually checked to see if each has a similar volume of solution. The microplate is then incubated at room temperature for 30 minutes. The microplates are again washed five times with 250 μL of PBST buffer and the washing time is recorded.

3. Prepare Allergen Standard and Assay Samples

The microplate layout is determined. The preferred layout is shown in Table 6 of Procedure #107.

The standard concentration and sample dilution is determined as shown in Table 10.

TABLE 10

| standard concentration (ng/mL)/sample dilution (1:1) for Can f1 Assay | | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Row A | 80 | 40 | 20 | 10 | 5 | 2.5 | 1.25 | 0.63 | 0.31 | 0.16 | BK | BK |
| Row B | 80 | 40 | 20 | 10 | 5 | 2.5 | 1.25 | 0.63 | 0.31 | 0.16 | BK | BK |
| Row C | 80 | 40 | 20 | 10 | 1:1 | 1:2 | 1:4 | 1:8 | 1:1 | 1:2 | 1:4 | 1:8 |
| Row D | 1:1 | 1:2 | 1:4 | 1:8 | 1:1 | 1:2 | 1:4 | 1:8 | 1:1 | 1:2 | 1:4 | 1:8 |
| Row V | 1:1 | 1:2 | 1:4 | 1:8 | 5 | 2.5 | 1.25 | 0.63 | 1:1 | 1:2 | 1:4 | 1:8 |
| Row F | 1:1 | 1:2 | 1:4 | 1:8 | 1:1 | 1:2 | 1:4 | 1:8 | 1:1 | 1:2 | 1:4 | 1:8 |
| Row G | 1:1 | 1:2 | 1:4 | 1:8 | 1:1 | 1:2 | 1:4 | 1:8 | 1:1 | 1:2 | 1:4 | 1:8 |
| Row H | 1:1 | 1:2 | 1:4 | 1:8 | 1:1 | 1:2 | 1:4 | 1:8 | 0.31 | 0.16 | BK | BK |

The volume of BSA PBST buffer in each well is determined as shown in Table 11.

TABLE 11

| BSA PBST buffer volume (μL) for Can f1 Assay | | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Row A | 180 | 100 | 100 | 100 | 100 | 100 | 100 | 100 | 100 | 100 | 100 | 100 |
| Row B | 180 | 100 | 100 | 100 | 100 | 100 | 100 | 100 | 100 | 100 | 100 | 100 |
| Row C | 180 | 100 | 100 | 100 | 0 | 100 | 100 | 100 | 0 | 100 | 100 | 100 |
| Row D | 0 | 100 | 100 | 100 | 0 | 100 | 100 | 100 | 0 | 100 | 100 | 100 |
| Row E | 0 | 100 | 100 | 100 | 100 | 100 | 100 | 100 | 0 | 100 | 100 | 100 |

TABLE 11-continued

| BSA PBST buffer volume (μL) for Can f1 Assay | | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Row F | 0 | 100 | 100 | 100 | 0 | 100 | 100 | 100 | 0 | 100 | 100 | 100 |
| Row G | 0 | 100 | 100 | 100 | 0 | 100 | 100 | 100 | 0 | 100 | 100 | 100 |
| Row H | 0 | 100 | 100 | 100 | 0 | 100 | 100 | 100 | 100 | 100 | 100 | 100 |

The sample and standard volume is determined as shown in Table 12.

TABLE 12

| sample and standard volume (μL) for Can f1 Assay | | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Row A | 20 | 0 | 0 | 0 | 0 | 0 | 0 | 0 | 0 | 0 | 0 | 0 |
| Row B | 20 | 0 | 0 | 0 | 0 | 0 | 0 | 0 | 0 | 0 | 0 | 0 |
| Row C | 20 | 0 | 0 | 0 | 100 | 100 | 0 | 0 | 100 | 100 | 0 | 0 |
| Row D | 100 | 100 | 0 | 0 | 100 | 100 | 0 | 0 | 100 | 100 | 0 | 0 |
| Row E | 100 | 100 | 0 | 0 | 0 | 0 | 0 | 0 | 100 | 100 | 0 | 0 |
| Row F | 100 | 100 | 0 | 0 | 100 | 100 | 0 | 0 | 100 | 100 | 0 | 0 |
| Row G | 100 | 100 | 0 | 0 | 100 | 100 | 0 | 0 | 100 | 100 | 0 | 0 |
| Row H | 100 | 100 | 0 | 0 | 100 | 100 | 0 | 0 | 0 | 0 | 0 | 0 |

The total required volume (V) of 1% BSA PBST solution is prepared in a pipette basin. The determined volume of BSA-PBST is added into each wells as is the determined volume of sample. Serial 2× dilutions are performed four times from D1/H1 sequentially to D4/H4 as shown in Table 7. Serial 2× dilutions are also performed four times from C5/D5 & F5/H5 sequentially to C8/D8 & F8/H8 and from C9/G9 sequentially to C12/G12.

20 uL of Fel d1 standard (Indoor Biotechnologies Inc.) is added in wells A1, B1, and C1. Serial 2× dilutions are performed from A1/B1 sequentially to A10/B10. Serial 2× dilutions are performed from C1 sequentially to C4, and then from E5 sequentially to E8, and then from H9 to H10.

The samples are then incubated at room temperature for two hours with the start time recorded. The microplates are washed five times with the 250 μL PBST buffer and the washing time is recorded.

4. Add Rabbit anti-Can f1 Antibody.

The total required volume (V) of 1/1000 dilution of an anti-Can f1 monoclonal antibody, preferably PA-CF1 (Indoor Biotechnologies Inc.), with 1% BSA-PBST buffer is prepared in a pipette basin. 100 μL of diluted PA-CF1 solution is pipetted into each well and incubated at room temperature for one hour. The start time is recorded. The microplates are then washed five times with a 250 uL PBS-T buffer and the washing time is recorded.

5. Add Peroxidase Conjugated Goat anti Rabbit IgG

The total required volume (V) of 1/1000 dilution reconstituted Goat anti Rabbit IgG with BSA-PBST is prepared. 100 uL of diluted Goat anti Rabbit IgG is pipetted into each well. The microplates are incubated at room temperature for one hour. The start time is recorded. The microplates are then washed five times with a 250 uL PBS-T buffer and the washing time is recorded.

6. Color Development

The total required volume (V) of 1/1000 dilution of 30% $H_2O_2$ with 1 mM ABTS-70 mM citrate phosphate buffer is prepared. 100 uL of diluted $H_2O_2$ solution is pipetted into each well. At least one minute passes prior to developing the next plates to allow sufficient time to read a plate before the next plate finishes color development. Each microplate is read at 405 nm repeatedly until the optical density of wells A1 and B1 reaches 2.0-2.4. The reading time is recorded and the ELISA procedure is recorded with ELISA reports.

Results

Figure 7:
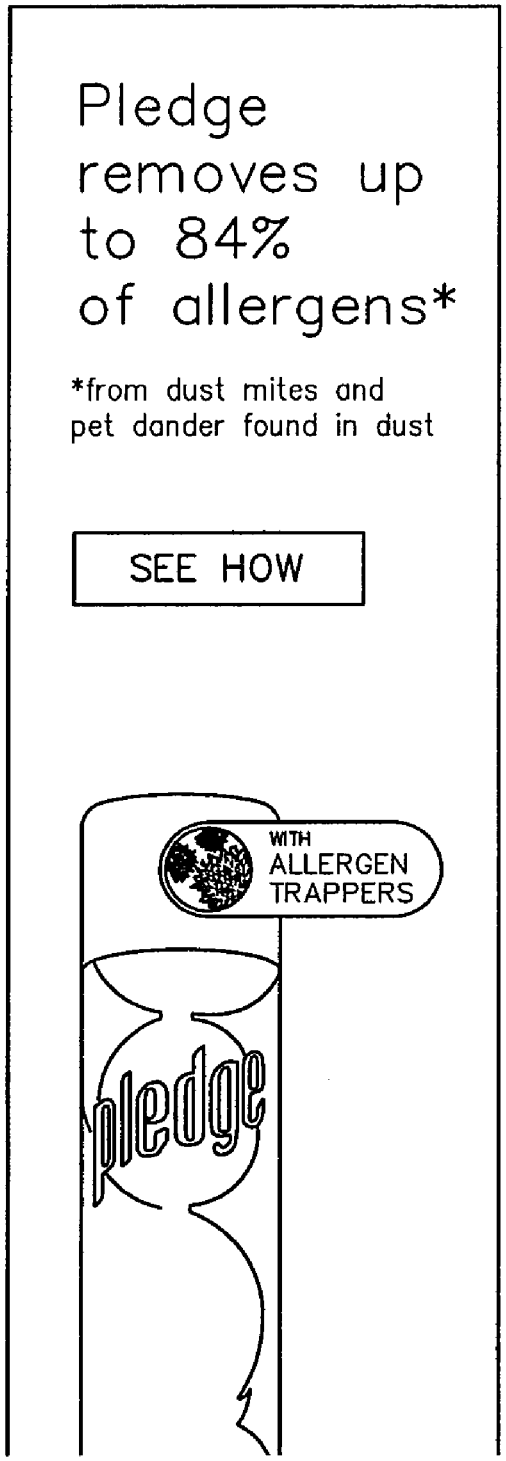
FIG. 7 is an image of an advertisement containing an allergen removal efficiency claim as determined by a preferred embodiment of the present invention.
Figure 8:
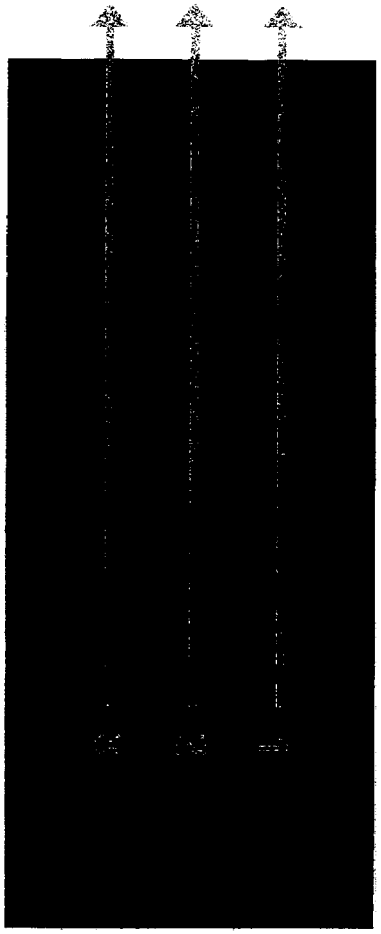
FIG. 8 is a schematic diagram of a three pass dusting procedure according to one embodiment of the invention.

Using the methodology described above, a ten replicate definitive study was conducted for an aerosol Pledge furniture polish cleaning product. This product was able to pick-up 93.0±9.0% of Fel d1 allergens and 94.6±13.7% of Can f1 allergens. This data may be used to support a product claim regarding allergen pick-up for this product such as is shown in FIG. 7. The product claim may be communicated to a consumer in a number of ways including, but not limited to, internet, television and radio advertising, free standing inserts in newspapers, and on product packaging.

The novel test method, with or without modifications, generates reproducible and reliable results to provide product claims for other cleaning products as well. This information may be communicated to consumers with the knowledge that the data is obtained from a reliable, repeatable and accurate test.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

It is intended that the appended claims cover all such additions, modifications and rearrangements. Expedient embodiments of the present invention are differentiated by the appended claims.

What is claimed is:

1. A method of determining the amount of allergens picked up by a cleaning product from a surface, the method comprising the steps of:

determining a deposition efficiency of a process used to deposit test material onto a surface;

determining an extraction efficiency of a process used to extract allergens from a cleaning product that is used to remove the test material from the surface;

applying the test material to the surface;

removing the test material from the surface with the cleaning product;

extracting allergens from the cleaning product;

determining a percentage of allergens removed from the surface; and determining a pick-up efficiency for the cleaning product from the percentage of allergens removed; and modifying the pick-up efficiency by the deposition efficiency and the extraction efficiency to obtain a corrected pick-up efficiency for the cleaning product, wherein the corrected pick-up efficiency is defined by the equation:

$$PU_{corrected} = \frac{PU}{\left(\frac{EX}{100}\right)\times\left(\frac{DE}{100}\right)},$$

wherein PU is the pick-up efficiency;

EX is the extraction efficiency; and

DE is the deposition efficiency; and wherein PU is defined by the equation:

$$PU = \frac{C_{allergen-PU}\times V_{PU}}{M_{dust-PU}\times C_{allergen-\text{in}-dust}}\times 100,$$

wherein $C_{allergen-PU}$ is allergen concentration in wash solution used for extracting the allergens from the cleaning product;

$V_{PU}$ is volume of wash solution used for extracting the allergens from the cleaning product;

$M_{dust-PU}$ is mass of the test material; and $C_{allergen-in-dust}$ is allergen concentration in the test material.

2. The method of claim 1, wherein the allergen-containing test material is dust, and wherein the dust is applied to the surface through a dust containment unit.

3. The method of claim 1, wherein the allergens are at least one of: cat allergens, dog allergens, dust mite allergens, mold allergens, pollen allergens and cockroach allergens.

4. The method of claim 1, wherein the cleaning product comprises a furniture polish applied to a dusting cloth.

5. The method of claim 4, wherein the dusting cloth is a cotton cloth.

6. The method of claim 1, further comprising the step of:

advertising the percentage of allergens removed from the surface by the cleaning product.

7. A method of determining the percentage of allergens picked up by a cleaning product, the method comprising the acts of:

applying allergen-containing test material to a surface;

using the cleaning product to remove a majority of the test material from the surface;

extracting the allergens from the cleaning product;

calculating a percentage of allergens picked up by the cleaning product; and modifying the percentage by inefficiencies in the application of the test material to the surface and by inefficiencies in the extraction of the allergens from the cleaning product to determine a corrected allergen pickup percentage, and wherein the corrected allergen pick-up percentage is defined by the equation:

$$PU_{corrected} = \frac{PU}{\left(\frac{EX}{100}\right)\times\left(\frac{DE}{100}\right)},$$

wherein PU is the percentage of allergens picked up;

EX is an extraction efficiency derived from the inefficiencies in the extraction of the allergens from the cleaning product; and DE is a deposition efficiency derived from the inefficiencies in the application of the test material to the surface; and wherein PU is defined by the equation:

$$PU = \frac{C_{allergen-PU}\times V_{PU}}{M_{dust-PU}\times C_{allergen-\text{in}-dust}}\times 100,$$

wherein $C_{allergen-PU}$ is allergen concentration in wash solution used for extracting the allergens from the cleaning product;

$V_{PU}$ is volume of wash solution used for extracting the allergens from the cleaning product;

$M_{dust-PU}$ is mass of the test material; and $C_{allergen-in-dust}$ is allergen concentration in the test material.

8. The method of claim 7, further comprising the act of:

determining a concentration of allergens in the test material.

9. The method of claim 7, further comprising the act of:

determining a percentage of allergens deposited onto the surface when the test material is applied to the surface.

10. The method of claim 7, wherein the cleaning product comprises furniture polish applied to a cleaning cloth.

11. The method of claim 10, further comprising the act of:

determining a percentage of allergens extracted from the cleaning product.

12. A method of determining the percentage of allergens picked up by a cleaning product from a surface, the method comprising the acts of:

determining an allergen concentration in a test material ($C_{allergen-in-dust}$);

measuring the mass of the test material ($M_{dust-PU}$);

applying the test material to a surface;

removing a portion of the test material with a cleaning product;

measuring a volume of a wash solution ($V_{PU}$);

extracting a portion of the allergens from the cleaning product in the solution;

measuring an allergen concentration in the solution ($C_{allergen-PU}$);

calculating an allergen pick up efficiency (PU) using the following equation:

$$PU = \frac{C_{allergen-PU}\times V_{PU}}{M_{dust-PU}\times C_{allergen-in-dust}}\times 100$$

determining an allergen deposition efficiency of the test material (DE);

determining an extraction efficiency of collected allergens extracted into the solution (EX); and calculating a corrected allergen pick up efficiency ($PU_{corrected}$) with the following equation:

$$PU_{corrected} = \frac{PU}{\left(\frac{EX}{100}\right)\times\left(\frac{DE}{100}\right)}.$$

13. The method of claim 12, further comprising the act of: communicating the corrected allergen pick up efficiency ($PU_{corrected}$) to a consumer.

14. The method of claim 6 wherein advertising the percentage of allergens removed includes displaying a numerical value correspond to the percentage on packaging for the cleaning product.

15. The method of claim 12 wherein the allergens are at least one of: cat allergens, dog allergens, dust mite allergens, mold allergens, pollen allergens and cockroach allergens.

16. The method of claim 10 wherein the cloth is made of cotton.

17. The method of claim 7 wherein the allergens are at least one of: cat allergens, dog allergens, dust mite allergens, mold allergens, pollen allergens and cockroach allergens.

18. The method of claim 1 wherein the test material is a synthetic product designed to simulate household dust.

* * * * *

UNITED STATES PATENT AND TRADEMARK OFFICE

CERTIFICATE OF CORRECTION

PATENT NO. : 7,976,639 B2
APPLICATION NO. : 11/840824
DATED : July 12, 2011
INVENTOR(S) : Mark M. Gipp et al.

It is certified that error appears in the above-identified patent and that said Letters Patent is hereby corrected as shown below:

IN THE CLAIMS:

Column 25, Claim 14, Line 12: replace “correspond” with --corresponding--

Signed and Sealed this
Seventh Day of August, 2012

David J. Kappos

David J. Kappos
*Director of the United States Patent and Trademark Office*